US008534993B2

(12) United States Patent
Lutjen et al.

(10) Patent No.: US 8,534,993 B2
(45) Date of Patent: Sep. 17, 2013

(54) GAS TURBINE ENGINES AND RELATED SYSTEMS INVOLVING BLADE OUTER AIR SEALS

(75) Inventors: Paul M. Lutjen, Kennebunkeport, ME (US); Susan M Tholen, Kennebunk, ME (US)

(73) Assignee: United Technologies Corp., Hartford, CT (US)

( * ) Notice: Subject to any disclaimer, the term of this patent is extended or adjusted under 35 U.S.C. 154(b) by 1618 days.

(21) Appl. No.: 12/030,289

(22) Filed: Feb. 13, 2008

(65) Prior Publication Data

US 2013/0213057 A1 Aug. 22, 2013

(51) Int. Cl.
*F01D 25/26* (2006.01)

(52) U.S. Cl.
USPC ..... 415/139; 415/173.4

(58) Field of Classification Search
USPC ..... 415/138, 139, 173.1; 416/193 A
See application file for complete search history.

(56) References Cited

U.S. PATENT DOCUMENTS 3,752,598 A * 8/1973 Bowers et al. ..... 415/115
4,466,772 A 8/1984 Okapuu et al.
4,623,298 A * 11/1986 Hallinger et al. ..... 415/139
4,861,618 A 8/1989 Vine et al.
5,238,364 A * 8/1993 Kreitmeier ..... 415/173.1
5,333,992 A * 8/1994 Kane et al. ..... 415/138
5,474,417 A * 12/1995 Privett et al. ..... 415/58.5
5,531,457 A * 7/1996 Tibbott et al. ..... 277/590
5,705,231 A 1/1998 Nissley et al.
5,780,171 A 7/1998 Nissley et al.
6,261,053 B1 7/2001 Anderson et al.
6,340,286 B1 1/2002 Aksit et al.
6,358,002 B1 3/2002 Good et al.
6,464,453 B2 10/2002 Toborg et al.
6,533,542 B2 3/2003 Sugishita et al.
6,547,522 B2 4/2003 Turnquist et al.
6,899,339 B2 5/2005 Sanders et al.
6,997,673 B2 2/2006 Morris et al.
7,001,145 B2 2/2006 Couture et al.
7,033,138 B2 4/2006 Tomita et al.
7,128,522 B2 * 10/2006 Jutras ..... 415/1
7,217,081 B2 * 5/2007 Scheurlen et al. ..... 415/1
7,670,108 B2 3/2010 Liang

* cited by examiner

*Primary Examiner* — Dwayne J White

(57) ABSTRACT

Gas turbine engines and related systems involving blade outer air seals are provided. In this regard, a representative blade outer air seal segment for a set of rotatable blades includes: a blade arrival end; and a blade departure end; each of the blade arrival end and the blade departure end being angularly offset with respect to a longitudinal axis about which the blades rotate.

22 Claims, 3 Drawing Sheets

GAS TURBINE ENGINES AND RELATED SYSTEMS INVOLVING BLADE OUTER AIR SEALS

STATEMENT REGARDING FEDERALLY SPONSORED RESEARCH AND DEVELOPMENT

The U.S. Government may have an interest in the subject matter of this disclosure as provided for by the terms of contract number N00019-02-C-3003, awarded by the United States Navy, and contract number F33615-03-D-2345 DO-0009, awarded by the United States Air Force.

BACKGROUND

1. Technical Field

The disclosure generally relates to gas turbine engines.

2. Description of the Related Art

A typical gas turbine engine incorporates a compressor section and a turbine section, each of which includes rotatable blades and stationary vanes. Within a surrounding engine casing, the radial outermost tips of the blades are positioned in close proximity to outer air seals. Outer air seals are parts of shroud assemblies mounted within the engine casing. Each outer air seal typically incorporates multiple segments that are annularly arranged within the engine casing, with the inner diameter surfaces of the segments being located closest to the blade tips.

SUMMARY

Gas turbine engines and related systems involving blade outer air seals are provided. In this regard, an exemplary embodiment of a blade outer air seal assembly for a gas turbine engine, the engine having a longitudinal axis and rotatable blades, each of the blades having a blade tip, the blade outer air seal assembly comprising: an annular arrangement of outer air seal segments, each of the segments having ends, the segments being positioned in an end-to-end orientation such that each adjacent pair of the segments forms an intersegment gap therebetween, each intersegment gap being angularly offset with respect to a longitudinal axis of the gas turbine engine.

An exemplary embodiment of a gas turbine engine comprises: a compressor; a combustion section; a turbine operative to drive the compressor responsive to energy imparted thereto by the combustion section, the turbine having a rotatable set of blades, the compressor and the turbine being oriented along a longitudinal axis; and a blade outer air seal assembly positioned radially outboard of the blades, the outer air seal assembly having an annular arrangement of outer air seal segments with intersegment gaps being located between the segments, each intersegment gap being angularly offset with respect to the longitudinal axis.

An exemplary embodiment of a blade outer air seal segment for a set of rotatable blades comprises: a blade arrival end; and a blade departure end; each of the blade arrival end and the blade departure end being angularly offset with respect to a longitudinal axis about which the blades rotate.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engines and related systems involving blade outer air seals are provided, several exemplary embodiments of which will be described in detail. In some embodiments, the ends of the outer air seal segments are angularly offset with respect to a longitudinal axis of the gas turbine in which the segments are mounted. In some of these embodiments, the ends of two adjacent segments are shaped to correspond to the mean camber line of the blades at the blade tips. In this manner, a pressure differential between the suction side and the pressure side of a blade as that blade crosses the adjacent ends of the segments tends to be stabilized. In particular, the location of the highest pressure differential during blade passage may tend to wander less along the gap formed between the adjacent segments and/or the rate of hot gas ingestion into the gap may be reduced. Notably, stabilizing of the transient nature of the pressure differential as each blade crosses the gap may allow for a decrease in overall cooling air applied to cool the segments. This may be the case because the region of highest hot gas ingestion along a segment, which corresponds to at least one of a highest temperature of hot gas and a highest volume of hot gas, may be relatively stationary. Thus, increased cooling air can be specifically directed to those regions and less cooling air can be directed to others.

Figure 1:
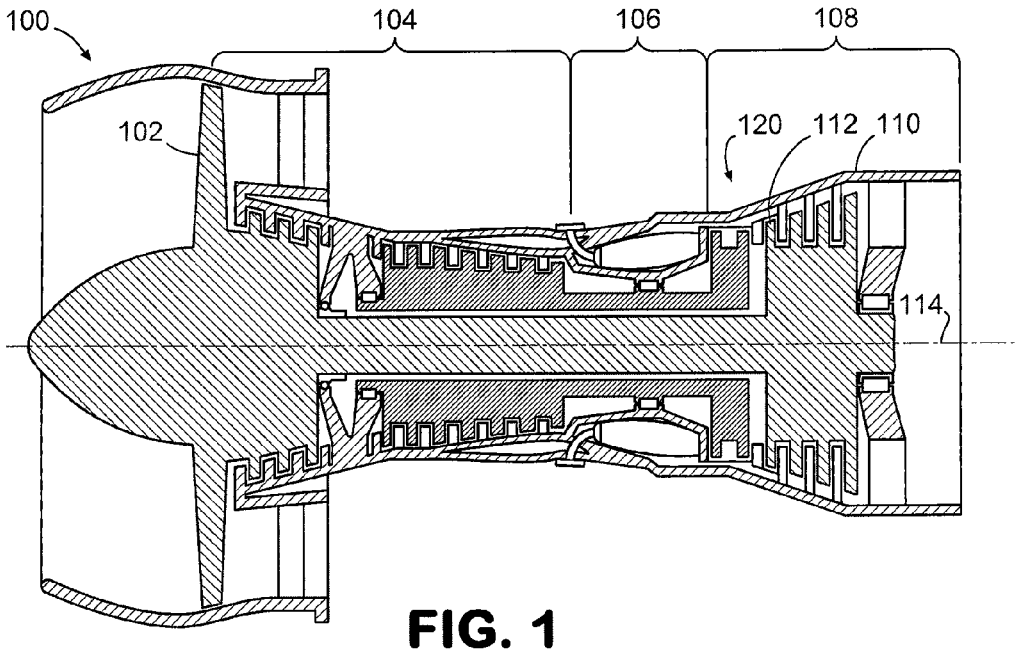
FIG. 1 is a schematic diagram depicting an exemplary embodiment of a gas turbine engine.

Referring now in more detail to the drawings, FIG. 1 is a schematic diagram depicting an exemplary embodiment of a gas turbine engine. As shown in FIG. 1, engine 100 incorporates a fan 102, a compressor section 104, a combustion section 106 and a turbine section 108. Various components of the engine are housed within an engine casing 110, such as a blade 112 of the low-pressure turbine, that extends along a longitudinal axis 114. Although engine 100 is configured as a turbofan engine, there is no intention to limit the concepts described herein to use with turbofan engines as various other configurations of gas turbine engines can be used.

Figure 2:
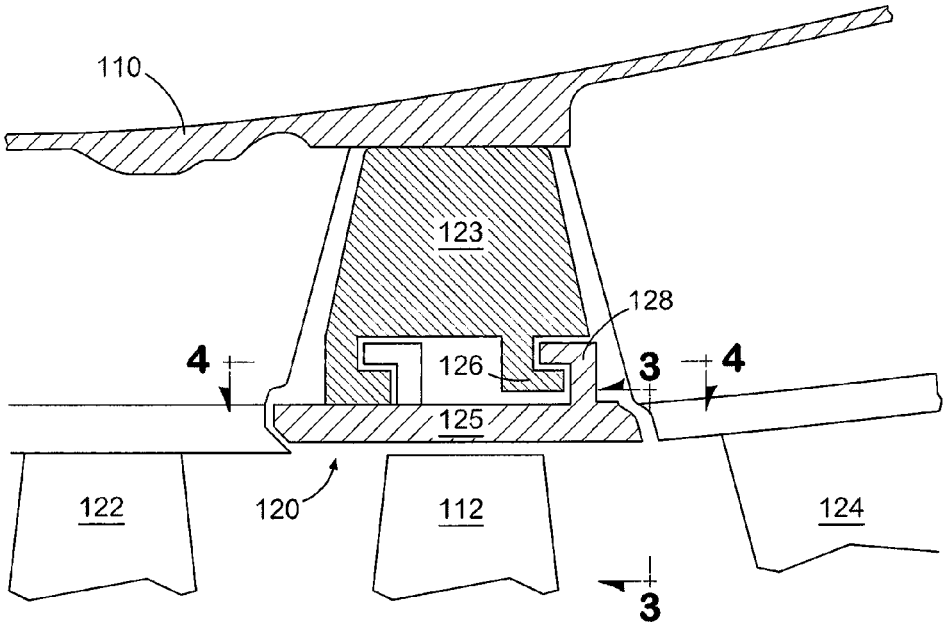
FIG. 2 is a partially cut-away, schematic diagram depicting a portion of the embodiment of FIG. 1.

A portion of engine 100 is depicted in greater detail in the schematic diagram of FIG. 2. In particular, FIG. 2 depicts a portion of blade 112 and a corresponding portion of a shroud assembly 120 that are located within engine casing 110. Notably, blade 112 is positioned between vanes 122 and 124, detail of which has been omitted from FIG. 2 for ease of illustration and description.

As shown in FIG. 2, shroud assembly 120 is positioned between the rotating blades and the casing. The shroud assembly generally includes an annular mounting ring 123 and an annular outer air seal 125 attached to the mounting ring and positioned adjacent to the blades. Various other seals are provided both forward and aft of the shroud assembly. However, these various seals are not relevant to this discussion.

Attachment of the outer air seal to the mounting ring in the embodiment of FIG. 2 is facilitated by interlocking flanges. Specifically, the mounting ring includes flanges (e.g., flange 126) that engage corresponding flanges (e.g., flange 128) of the outer air seal. Other attachment techniques may be used in other embodiments.

Figure 3:
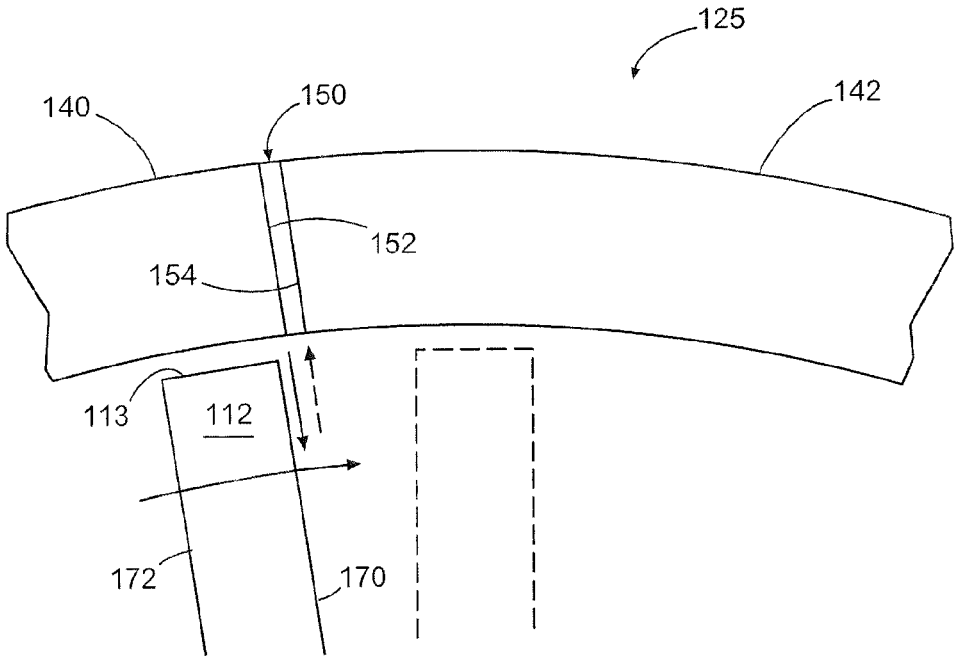
FIG. 3 is a partially cut-away, schematic diagram depicting a portion of the shroud assembly of the embodiment of FIGS. 1 and 2 as viewed along section line 3-3.

With respect to the annular configuration of the outer air seal, outer air seal 125 is formed of multiple arcuate segments, portions of two of which are depicted schematically in FIG. 3. As shown in FIG. 3, adjacent segments 140, 142 of the outer air seal are oriented in an end-to-end relationship, with an intersegment gap 150 located between the segments. Notably, blade 112 is depicted in solid lines, with the direction of rotation of blade 112 being indicated by the overlying arrow. A predicted position of blade 112 after the blade tip 113 rotates past the intersegment gap is depicted in dashed lines.

Figure 4:
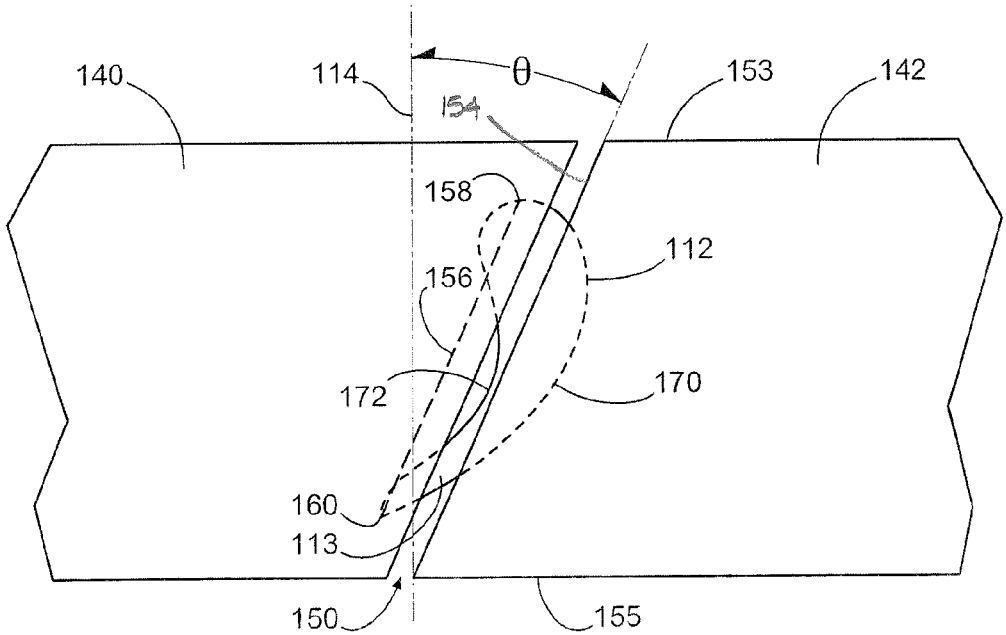
FIG. 4 is a partially cut-away, schematic diagram depicting a portion of the shroud assembly of the embodiment of FIGS. 1 and 2 as viewed along section line 4-4.

Portions defining the intersegment gap include a blade departure end 152 of segment 140 and a blade arrival end 154 of segment 142. As shown in FIG. 4, the intersegment gap 150 located between the ends of the segments is angularly offset with respect to longitudinal axis 114. In this embodiment, the angular offset (θ), which is defined along a line extending between the leading edge (e.g., edge 153) and trailing edge (e.g., 155) of a segment end, corresponds to the angular offset exhibited by the chord 156 of blade 112 at the blade tip. Note that chord 156 is defined by a line extending between the leading edge 158 and the trailing edge 160 of the blade. Thus, during blade passage, the leading and trailing edges of the blade of this embodiment transit the gap simultaneously, or nearly so.

The aforementioned configuration may tend to reduce hot gas ingestion and corresponding distress exhibited by the ends of the segments. Notably, the advancing suction side of each rotating blade (e.g., side 170 of blade 112) tends to promote a radial inboard-directed flow of cooling air (depicted by the solid arrow) from the intersegment gap. In contrast, the retreating pressure side of each rotating blade (e.g., side 172 of blade 112) tends to promote a radial outboard-directed ingestion flow of hot gas (depicted by the dashed arrow) into the intersegment gap. By providing an angular offset of the intersegment gap, as defined by the ends of the outer air seal segments, radial penetration of hot gas along the intersegment gap may be reduced. This characteristic may be attributable to a reduction in the length of the intersegment gap over which the instantaneous axial pressure gradient occurs.

In other embodiments, various angular offsets other than those directly corresponding to the blade chord can be used. By way of example, angular offsets of between approximately 5° and approximately 70°, preferably between approximately 20° and approximately 60°, and most preferably between approximately 30° and approximately 45°, can be used. Notably, passage of an intersegment gap by the leading and trailing edges of a blade may occur separately in some embodiments.

Another aspect of the embodiment of FIGS. 1-4 relates to the degree to which a transiting blade tends to obstruct an intersegment gap during passage of the gap. That is, unlike conventional gaps, which tend to be aligned with the longitudinal axis of a gas turbine engine, the angular offset tends to orient the gap so that more of the gap is obstructed by the blade tip during blade passage. Such a physical obstruction tends to reduce the rate and/or volume of hot gas moving past the blade tip for ingestion into the gap.

Figure 5:
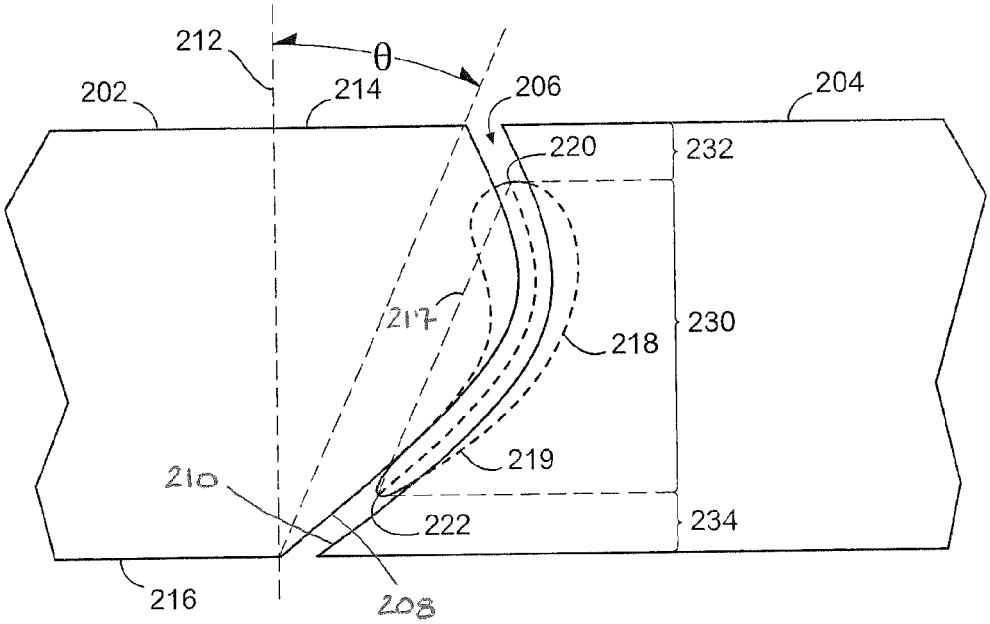
FIG. 5 is a partially cut-away, schematic diagram depicting a portion of another embodiment of a shroud assembly.

FIG. 5 is a partially cut-away, schematic diagram depicting a portion of another embodiment of a shroud assembly. In FIG. 5, portions of adjacent outer air seal segments 202, 204 defining an intersegment gap 206 are depicted. Specifically, blade departure end 208 of segment 202 and blade arrival end 210 of segment 204 define intersegment gap 206. Notably, intersegment gap 206 is angularly offset with respect to a longitudinal axis 212 of a gas turbine in which the segments are to be mounted. In this embodiment, the angular offset (θ), which is defined along a line extending between the leading edge (e.g., edge 214) and trailing edge (e.g., edge 216) of a segment end, corresponds to the angular offset of the chord 217 of blade 218 at the blade tip 219. Note that chord 217 is defined by a line extending between the leading edge 220 and the trailing edge 222 of the blade. Thus, during blade passage of the gap, the leading and trailing edges of the blade of this embodiment transit the gap simultaneously, or nearly so.

In contrast to the embodiment of FIGS. 1-4, the gap 206 of the embodiment of FIG. 5 is not linear. Specifically, gap 206 includes a blade passage region 230, a leading edge region 232 and a trailing edge region 234.

In this embodiment, blade passage region 230 of the gap exhibits a shape that generally corresponds to the mean camber line of the blade at the blade tip (i.e., a line defined by points equidistant from the suction side and pressure side surfaces of the blade tip). The leading and trailing edge regions, which are axially located fore and aft, respectively, of the blade passage region, continue the curvature of the blade passage region. In other embodiments, various other types of curvature can be used for forming an intersegment gap. By way of example, an intermediate portion of the gap (e.g., that portion of the gap located adjacent to the blade tips) can exhibit a shape that generally corresponds to the mean camber line of the blades, while the portions of the gap in the vicinity of the leading and trailing edges can be oriented generally axially. Such a shape may tend to reduce hot gas ingestion, particularly at the leading edge of the gap as the gap shape would not match the airflow direction coming off of the tips of the passing blades.

It should be noted that the angular offset of blade arrival end 154 of segment 142 is depicted in FIG. 4, whereas the angular offset of blade departure end 208 of segment 202 is depicted in FIG. 5. In those embodiments, the ends of the respective adjacent segments exhibit similar angular offsets. However, variations due to manufacturing tolerances, for example, may be present.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A blade outer air seal assembly for a gas turbine engine, the engine having a longitudinal axis and rotatable blades, each of the blades having a blade tip, the blade outer air seal assembly comprising:

an annular arrangement of outer air seal segments, each of the segments having ends, the segments being positioned in an end-to-end orientation such that each adjacent pair of the segments forms an intersegment gap therebetween, each intersegment gap being angularly offset with respect to a longitudinal axis of the gas turbine engine.

2. The assembly of claim 1, wherein an angular offset of each of the ends of the segments is between approximately 5° and approximately 70°.

3. The assembly of claim 2, wherein the angular offset of each of the ends is between approximately 20° and approximately 60°.

4. The assembly of claim 1, wherein an angular offset of each of the ends corresponds to an angular offset exhibited by a chord of a blade tip of at least one of the blades.

5. The assembly of claim 4, wherein the angular offset of each of the ends corresponds to a mean camber line of a blade tip of at least one of the blades.

6. The assembly of claim 5, wherein:

each intersegment gap has a blade passage region adjacent to which the blades transit during rotation; and each blade passage region exhibits a curvature corresponding to the mean camber line of a blade tip of at least one of the blades.

7. The assembly of claim 6, wherein:

each intersegment gap has a leading edge portion extending forward from a corresponding blade passage region; and each leading edge portion is linear in shape.

8. The assembly of claim 6, wherein:

each intersegment gap has a leading edge portion extending forward from a corresponding blade passage region; and each leading edge portion exhibits a curvature corresponding to a curvature of the blade passage region.

9. A gas turbine engine comprising:

a compressor;

a combustion section;

a turbine operative to drive the compressor responsive to energy imparted thereto by the combustion section, the turbine having a rotatable set of blades, the compressor and the turbine being oriented along a longitudinal axis; and a blade outer air seal assembly positioned radially outboard of the blades, the outer air seal assembly having an annular arrangement of outer air seal segments with intersegment gaps being located between the segments, each intersegment gap being angularly offset with respect to the longitudinal axis.

10. The engine of claim 9, wherein:

each of the intersegment gaps exhibits a region of highest hot gas ingestion corresponding to at least one of a highest temperature of hot gas and a highest volume of hot gas; and the engine is operative to direct cooling air preferentially to the region of highest hot gas ingestion.

11. The engine of claim 9, wherein an angular offset of each of the ends corresponds to an angular offset exhibited by a chord of a blade tip of at least one of the blades.

12. The engine of claim 9, wherein an angular offset of each of the ends corresponds to a mean camber line of a blade tip of at least one of the blades.

13. The engine of claim 9, wherein an angular offset of each of the ends of the segments is between approximately 5° and approximately 70°.

14. The engine of claim 13, wherein the angular offset of each of the ends is between approximately 20° and approximately 60°.

15. The engine of claim 9, wherein:

each intersegment gap has a blade passage region adjacent to which the blades transit during rotation; and each blade passage region exhibits a curvature corresponding to the mean camber line of a blade tip of at least one of the blades.

16. A blade outer air seal segment for a gas turbine engine including an engine casing and a set of rotatable blades, comprising:

a flange adapted to attach to the engine casing;

a blade arrival end; and a blade departure end;

each of the blade arrival end and the blade departure end being angularly offset with respect to a longitudinal axis about which the blades rotate.

17. The segment of claim 16, wherein the angular offset of each of the blade arrival end and the blade departure end corresponds to a mean camber line of a blade tip of at least one of the blades.

18. The segment of claim 16, wherein the angular offset of each of the blade arrival end and the blade departure end is between approximately 5° and approximately 70°.

19. The segment of claim 16, wherein the angular offset of each of the blade arrival end and the blade departure end corresponds to a chord of a blade tip of at least one of the blades.

20. The segment of claim 16, wherein the angular offset of each of the ends is operative to stabilize a pressure differential between a suction side and a pressure side of a blade as that blade crosses the ends.

21. The assembly of claim 1, wherein the arrangement of outer air seal segments is adapted to attach to a casing of the gas turbine engine.

22. The engine of claim 9, wherein the rotatable set of blades rotate within and relative to the blade outer air seal assembly.

* * * * *